US006971635B1

(12) United States Patent
Foster

(10) Patent No.: US 6,971,635 B1
(45) Date of Patent: Dec. 6, 2005

(54) DECK BOARD SETTING ASSEMBLY

(76) Inventor: Roy E. Foster, 710 Westwood Dr., Catlin, IL (US) 61817

( * ) Notice: Subject to any disclaimer, the term of this patent is extended or adjusted under 35 U.S.C. 154(b) by 85 days.

(21) Appl. No.: 10/725,834

(22) Filed: Dec. 3, 2003

(51) Int. Cl.[7] ..... B66F 3/00
(52) U.S. Cl. ..... 254/17
(58) Field of Search ..... 254/15, 17, 131, 254/11, 16, 120, 113; 29/267, 273

(56) References Cited

U.S. PATENT DOCUMENTS 1,283,209 A 10/1918 Kimble
2,780,437 A 2/1957 Ham
4,683,631 A 8/1987 Dobbertin
5,248,127 A 9/1993 Young
5,269,494 A 12/1993 Pittman et al.
5,527,014 A 6/1996 Bracewell

*Primary Examiner*—Robert C. Watson

(57) ABSTRACT

A deck board setting assembly includes a bracket assembly having a channel therein for removably receiving an upper edge of a deck stud. The bracket assembly has a forward side and a rearward side. A pivot rod is rotatably coupled to and extends away from the bracket assembly. The pivot rod is orientated perpendicular to the channel. A lever assembly is pivotally attached to the pivot rod. The lever assembly is selectively rotated in a first direction forward of the bracket assembly or in a second direction rearward of the bracket assembly. A locking assembly is attached to the lever assembly and the bracket assembly for selectively preventing rotation of the lever assembly in the second direction. The lever assembly may be rotated in the first direction such that the lever assembly abuts a loose horizontal board and urges the loose horizontal board away from the bracket assembly.

10 Claims, 5 Drawing Sheets

DECK BOARD SETTING ASSEMBLY

BACKGROUND OF THE INVENTION

1. Field of the Invention

The present invention relates to deck construction devices and more particularly pertains to a new deck construction device for urging a loose board against a board secured to a deck stud so that the loose board is held so that it too may be secured to the deck stud.

2. Description of the Prior Art the use of deck construction devices is known in the prior art. Such devices are shown in U.S. Pat. No. 2,780,437, U.S. Pat. No. 5,527,014 and U.S. Pat. No. 4,683,631. While these devices fulfill their respective, particular objectives and requirements, the need remains for a device that is simple to use in its construction for the particular task of placing together deck boards upon a stud. Such a device should allow a person constructing the deck to place the boards together so that there hands are free for the positioning of securing members and using a tool for inserting the securing members into the deck board.

SUMMARY OF THE INVENTION

The present invention meets the needs presented above by including a bracket assembly having a channel therein formed by a pair of plates for receiving the stud of a deck.

Another object of the present invention is to provide a new deck construction devices that includes a lever assembly pivotally coupled to the bracket assembly in such a manner that the lever assembly is rotatable within a plane orientated parallel to a plane of the stud. This allows for the lever to urge a loose deck board away from the bracket assembly and against a secured board. In this position, the loose deck board may be secured to the stud.

Still another object of the present invention is to provide a new deck construction device that includes a locking assembly for preventing the lever assembly from moving away from the loose board. This ensures that the user will have two free hands to use when securing the loose board to the stud.

To this end, the present invention generally comprises a bracket assembly having a channel therein for removably receiving an upper edge of a deck stud such that the bracket assembly extends downward on opposite sides of the stud. The bracket assembly has a forward side and a rearward side. A pivot rod is rotatably coupled to and extends away from the bracket assembly. The pivot rod is orientated perpendicular to the channel. A lever assembly is pivotally attached to the pivot rod. The lever assembly is selectively rotated in a first direction forward of the bracket assembly or in a second direction rearward of the bracket assembly. A locking assembly is attached to the lever assembly and the bracket assembly for selectively preventing rotation of the lever assembly in the second direction. The lever assembly may be rotated in the first direction such that the lever assembly abuts a loose horizontal board and urges the loose horizontal board away from the bracket assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
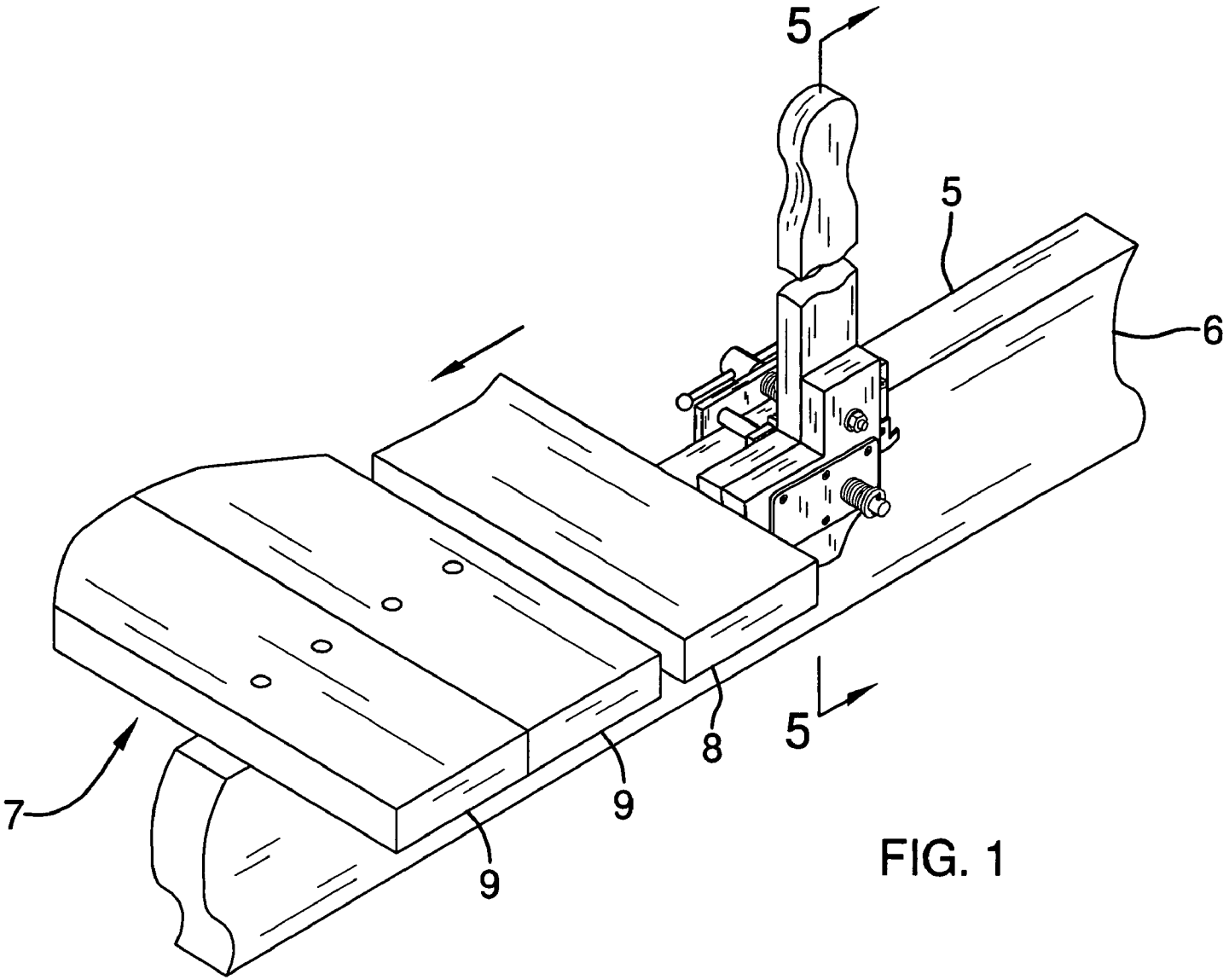
FIG. 1 is a schematic perspective environmental view of a deck board setting assembly according to the present invention.

With the reference now to the drawings, and in particular to FIGS. 1 through 5 thereof, a new deck construction device embodying the principles and concepts of the present invention and generally designated by the reference numeral 10 will be described.

As best illustrated in FIGS. 1 through 5, the deck board setting assembly 10 generally comprises a tool for removably attaching to an upper edge 5 of a stud 6 of a deck 7 for pressing together a loose horizontal board 8 against a secured horizontal board 9 positioned on the stud 6. Once pressed against the secured board 9, the loose board 8 may be secured to the stud 6 using conventional fasteners.

The tool assembly 10 includes a bracket assembly 12 having a channel 13 therein for removably receiving the upper edge 5 of the stud 6 such that the bracket assembly 12 extends downward on opposite sides of the stud 6. The bracket assembly 12 has a forward side 14 and a rearward side 15. The bracket assembly 12 includes first plate 17 and a second plate 18. A biasing member 19 is attached to the first 17 and second 18 plates for biasing the first plate 17 toward the second plate 18. The biasing member 19 preferably includes a threaded rod having a first end 20 rotatably attached to the second plate 18 and a second end 21 extending through the first plate 17. The threaded rod, or biasing member 19, is threadably coupled to the first plate 17. A grip 22 is attached to the second end 21 of the threaded rod 19. A guide rod 23 has an attached and 24 attached to the second plate 18 and a free end 25 extending through the first plate 17 such that the second plate 18 is selectively positionable along a length of the guide rod 23. The guide rod 23 and the biasing member 19 are positioned in a substantially horizontal plane with respect to each other. The horizontal plane is defined when the bracket assembly 12 is positioned on the stud 6. The first 17 and second 18 plates form the channel 13 and may each be abutted against one of the sides of the stud 6. The guide rod 23 and biasing member 19 may be positioned against the upper edge 5 of the stud 6. Preferably, a plurality of gripping members 26 is attached to each of the first 17 and second 18 plates. Each of the gripping members 26 extends inward with respect to the channel 13. The gripping members 26 grip the sides of the stud 6.

A pivot rod 30 is rotatably coupled to and extends away from the bracket assembly 12. The pivot rod 30 is orientated perpendicular to the channel 13. The pivot rod 30 extends through the first 17 and second 18 plates. The pivot rod 30 lies in the horizontal plane shared with threaded second end 32. The first end 31 of the pivot rod 30 is positioned adjacent to the first plate 17. The second end 32 is biased away from the second plate 18 by a spring 33.

A lever assembly 40 is pivotally attached to the pivot rod 30. The lever assembly 40 is selectively rotated in a first direction 41 forward of the bracket assembly 12 or in a second direction rearward of the bracket assembly 12. The lever assembly 40 includes a foot portion 42 having a top surface 43, a bottom surface 44, a rear surface 45 and front surface 46. The front surface 46 is arcuate from the top surface 43 to the bottom surface 44 and defines an arcuate edge defined by an arc having an axis aligned with the top surface 43. The pivot rod 30 extends through and is pivotally coupled to the foot portion 42. The foot portion 42 is positioned between the spring 33 and bracket assembly 13. This applies tension on the foot position 42 so that its rotation on the pivot rod 30 may be controlled. The pivot rod 30 is positioned generally between the axis of the arc and the bottom surface 44. The pivot rod 30 is orientated parallel to the axis of the arc. The positioning of the pivot rod 30 causes a juncture of the top surface 43 and the front surface 46 to extend forward when the foot portion 42 is rotated in the first direction 41 as shown by the directional arrow. A handle 47 is attached to and extends upwardly from the top surface 43. The handle 47 is preferably elongated and aids in rotated the foot portion 42.

Figure 2:
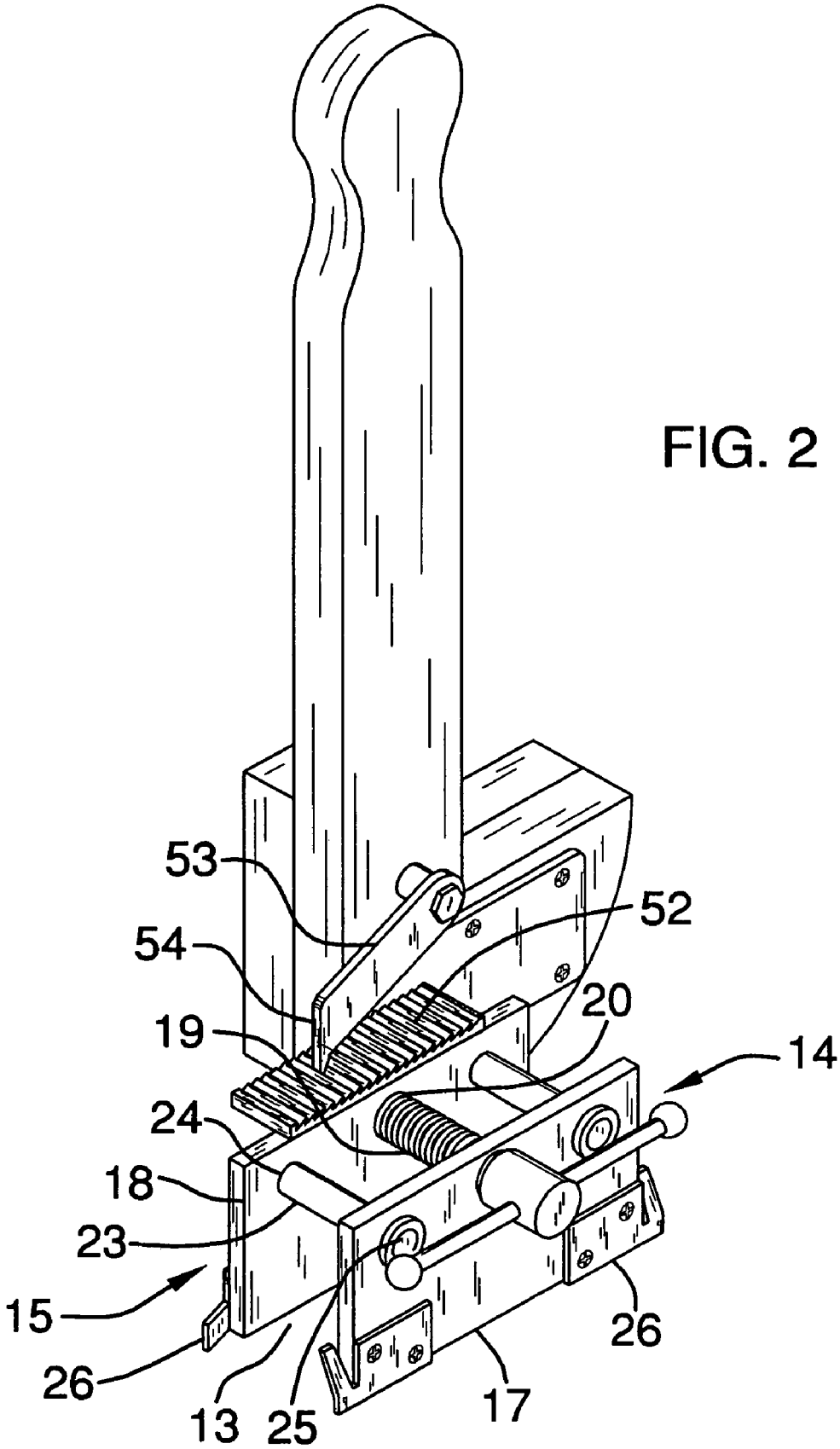
FIG. 2 is a schematic rear perspective view of the present invention.
Figure 3:
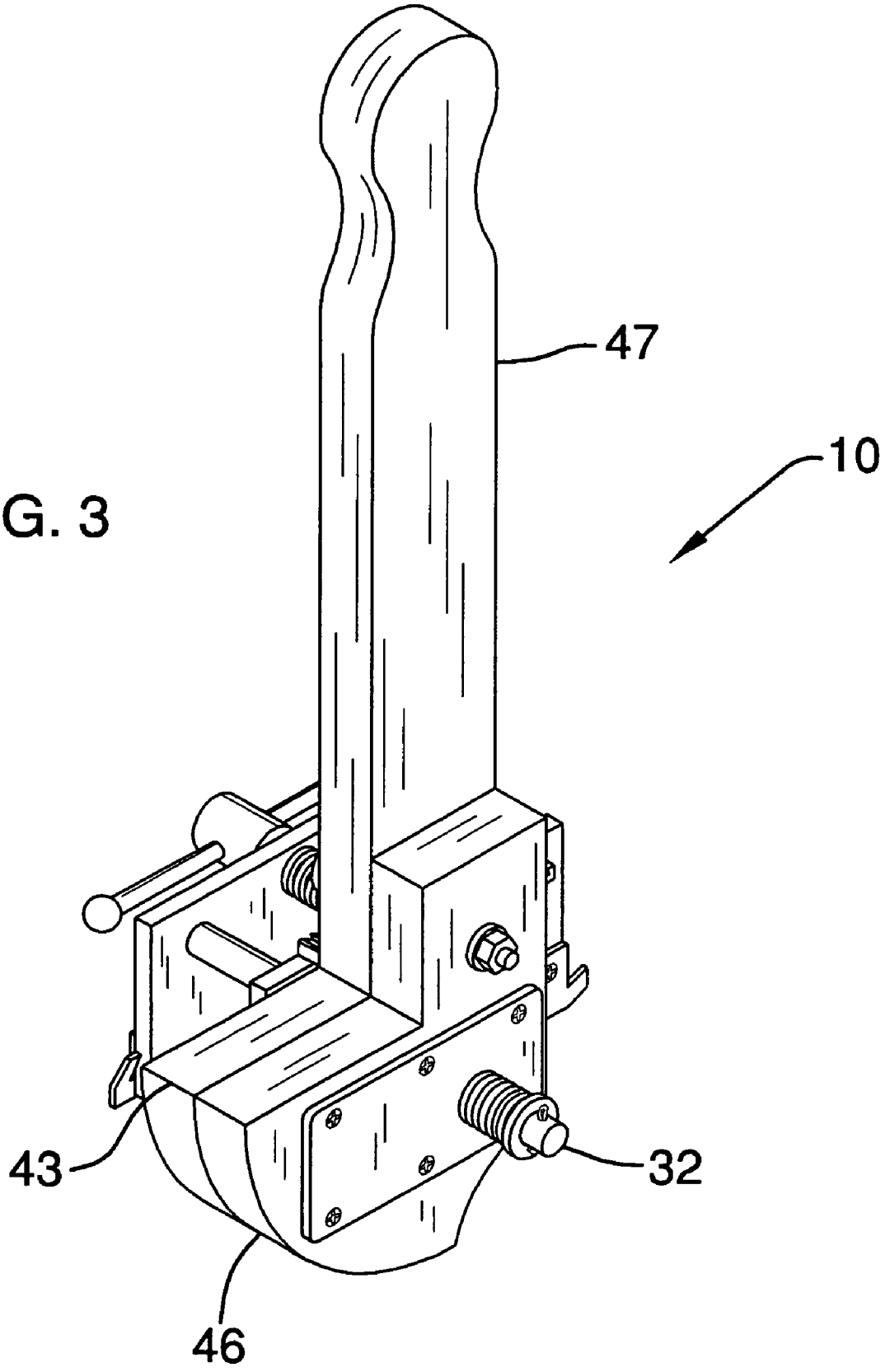
FIG. 3 is a schematic front perspective view of the present invention.
Figure 4:
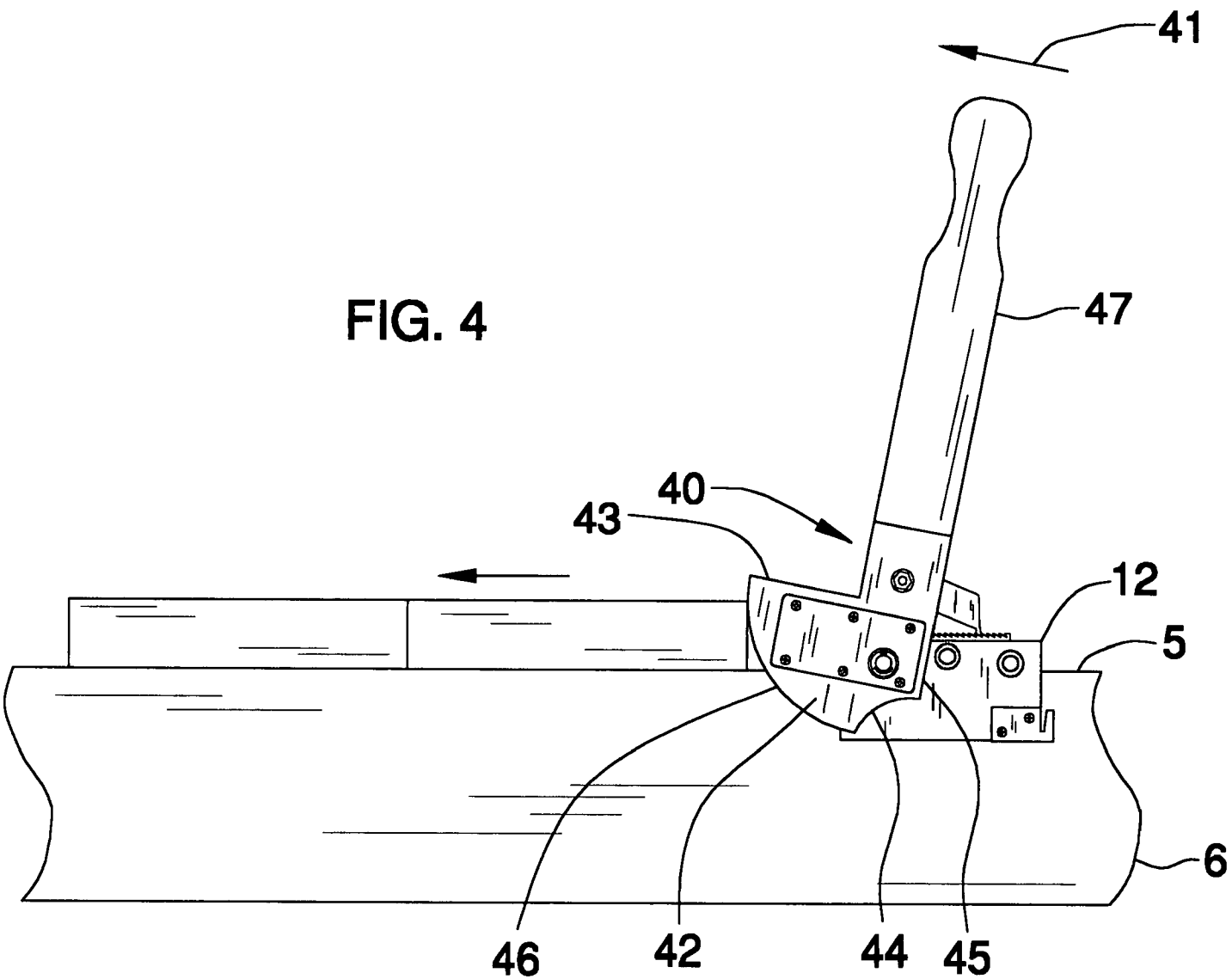
FIG. 4 is a schematic side view of the present invention.
Figure 5:
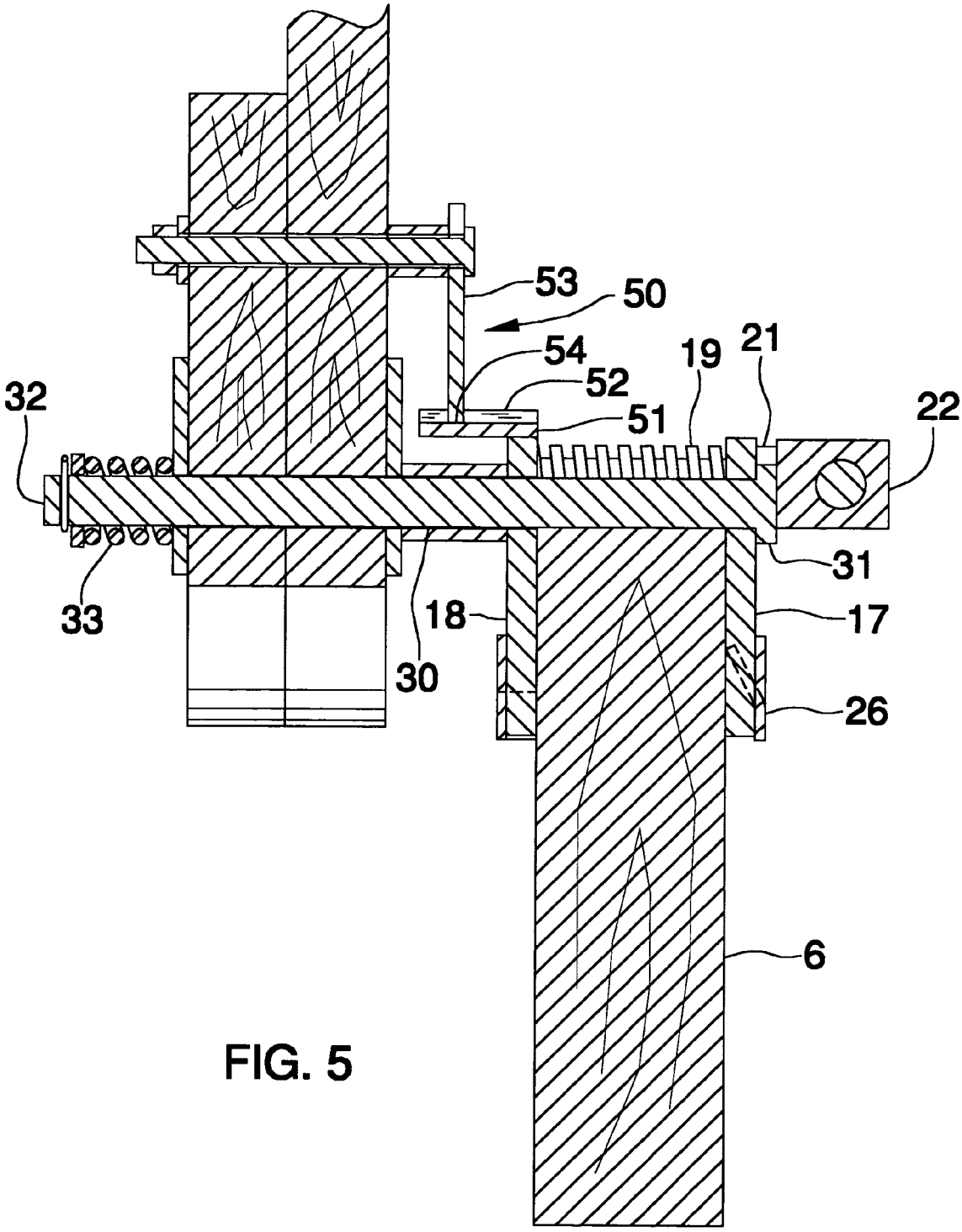
FIG. 5 is a schematic cross-sectional view taken along line 5—5 of FIG. 1 of the present invention.

A locking assembly 50 is attached to the lever assembly 40 and the bracket assembly 12 for selectively preventing rotation of the lever assembly 40 in the second direction. The locking assembly 50 includes a horizontally orientated panel 51 that is attached to the bracket assembly 12. A plurality of teeth 52 is positioned on the panel 51 and extends upwardly away therefrom. The teeth 52 are angled forward with respect to the bracket assembly 12. A pawl 53 is pivotally coupled to the lever assembly 40. The pawl 53 has a bottom end 54 that is selectively engaged with one of the teeth 52 when the pawl 53 is angled backward as shown in FIG. 2. This prevents the lever assembly 40 from moving in the second direction. The pawl 53 is angled back so that it moves forward freely over the teeth 52 as the lever assembly 40 is moved in the first direction.

In use, while constructing a deck, the bracket assembly 12 is positioned on one of the main support studs 6 as shown in FIG. 1. A loose board 8, which is the next board to be secured to the stud 6, is placed on the stud 6 between the bracket assembly 12 and a board 9 already secured to the stud 6. The space between the first 17 and second 18 plates may be adjusted for receiving the stud 5 and securing the bracket assembly 12 thereto. The lever assembly 40 may be rotated in the first direction such that the lever assembly 40 abuts the loose horizontal board 8 and urges it away from the bracket assembly 12 and toward the secured board 9. Once the loose board 8 abuts the secured board 9, the locking assembly 50 prevents the lever assembly 40 from rotating in the second direction.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A mounting tool for removably attaching to an upper edge of a stud of a deck for pressing together a loose horizontal board against a secured horizontal board positioned on the stud, said tool including:

a bracket assembly having a channel therein for removably receiving the upper edge of the stud such that said bracket assembly extends downward on opposite sides of the stud, said bracket assembly having a forward side and a rearward side, said bracket assembly including: a first plate and a second plate;

a biasing member being attached to said first and second plates for biasing said first plate toward said second plate, said biasing member including a threaded rod having a first end rotatably attached to said second plate and a second end extending through said first plate, said threaded rod being threadably coupled to said first plate;

a guide rod having an attached end being attached to said second plate and a free end extending through said first plate such that said second plate is selectively positionable along a length of said guide rod, said guide rod and said biasing member being positioned in a substantially horizontal plane, wherein each of said first and second plates forms said channel and may be abutted against one of the sides of the stud, said guide rod and biasing member being positionable against the upper edge of the stud;

a pivot rod being rotatably coupled to and extending away from said bracket assembly, said pivot rod being orientated perpendicular to said channel;

a lever assembly being pivotally attached to said pivot rod, said lever assembly being selectively rotated in a first direction forward of said bracket assembly or in a second direction rearward of said bracket assembly;

a locking assembly being attached to said lever assembly and said bracket assembly for selectively preventing rotation of said lever assembly in said second direction; and wherein said lever assembly may be rotated in said first direction such that said lever assembly abuts the loose horizontal board and urges the loose horizontal board away from the bracket assembly.

2. The tool of claim 1, further including a plurality of gripping members being attached to said first and second plate, each of said gripping members extending inward of said channel.

3. The tool of claim 1, wherein said pivot rod extends through said first and second plates.

4. The tool of claim 3, wherein said pivot rod lies in said horizontal plane.

5. The tool of claim 1, wherein said lever assembly includes a foot portion having a top surface, a bottom surface, a rear surface and front surface, said front surface being arcuate from said top surface to said bottom surface and defining an arcuate edge defined by an arc having an axis aligned with said top surface, said pivot rod extending through and being pivotally coupled to said foot portion, said pivot rod being positioned generally between said axis and said bottom surface, said pivot rod being orientated parallel to said axis, wherein a juncture of said top surface and said front surface extends forward when said foot portion is rotated in said first direction.

6. The tool of claim 5, further including a gripping member being attached to an extending upwardly from said top surface.

7. The tool of claim 1, wherein said locking assembly includes a horizontally orientated panel being attached to said bracket assembly, a plurality of teeth being positioned on said panel and extending upwardly away therefrom, said teeth being angled forward with respect to said bracket assembly, a pawl being pivotally coupled to said lever assembly, said pawl having a bottom end being selectively engaged with one of said teeth.

8. The tool of claim 5, wherein said locking assembly includes a horizontally orientated panel being attached to said bracket assembly, a plurality of teeth being positioned on said panel and extending upwardly away therefrom, said teeth being angled forward with respect to said bracket assembly, a pawl being pivotally coupled to said lever assembly, said pawl having a bottom end having selectively engaged with one of said teeth.

9. A mounting tool for removably attaching to an upper edge of a stud of a deck for pressing together a loose horizontal board against a secured horizontal board positioned on the stud, said tool including:

a bracket assembly having a channel therein for removably receiving the upper edge of the stud such that said bracket assembly extends downward on opposite sides of the stud, said bracket assembly having a forward side and a rearward side, said bracket assembly including: a first plate and a second plate;

a biasing member being attached to said first and second plates for biasing said first plate toward said second plate, said being member including a threaded rod having a first end rotatably attached to said second plate and a second end extending through said first plate, said threaded rod being threadably coupled to said first plate, a grip being attached to said first end;

a guide rod having an attached end being attached to said second plate and a free end extending through said first plate such that said second plate is selectively positionable along a length of said guide rod, said guide rod and said biasing member being positioned in a substantially horizontal plane, wherein each of said first and second plates forms said channel and may be abutted against one of the sides of the stud, and wherein said guide rod and biasing member may be positioned against the upper edge of the stud;

a plurality of gripping members being attached to said first and second plate, each of said gripping members extending inward of said channel;

a pivot rod being rotatably coupled to and extending away from said bracket assembly, said pivot rod being orientated perpendicular to said channel, said pivot rod extending through said first and second plates, said pivot rod lying in said horizontal plane, said pivot rod having a first end and a second end, said first end being positioned adjacent to said first plate, said second end being biased away from said second plate;

a lever assembly being pivotally attached to said pivot rod, said lever assembly being selectively rotated in a first direction forward of said bracket assembly or in a second direction rearward of said bracket assembly, said lever assembly including;

a foot portion having a top surface, a bottom surface, a rear surface and front surface, said front surface being arcuate from said top surface to said bottom surface and defining an arcuate edge defined by an are having an axis aligned with said top surface, said pivot rod extending through and being pivotally coupled to said foot portion, said pivot rod being positioned generally between said axis and said bottom surface, said pivot rod being orientated parallel to said axis, wherein a juncture of said top surface and said front surface extends forward when said foot portion is rotated in said first direction;

a gripping member being attached to an extending upwardly from said top surface;

a locking assembly being attached to said lever assembly and said bracket assembly for selectively preventing rotation of said lever assembly in said second direction, said locking assembly including:

a horizontally orientated panel being attached to said bracket assembly, a plurality of teeth being positioned on said panel and extending upwardly away therefrom, said teeth being angled forward with respect to said bracket assembly;

a pawl being pivotally coupled to said lever assembly, said pawl having a bottom end being selectively engaged with one of said teeth; and wherein said lever assembly may be rotated in said first direction such that said lever assembly abuts the loose horizontal board and urges the loose horizontal board away from the bracket assembly.

10. A mounting tool for removably attaching to an upper edge of a stud of a deck for pressing together a loose horizontal board against a secured horizontal board positioned on the stud, said tool including:

a bracket assembly having a channel therein for removably receiving the upper edge of the stud that said bracket assembly extends downward on opposite sides of the stud, said bracket assembly having a forward side and a rearward side;

a pivot rod being rotatably coupled to and extending away from said bracket assembly, said pivot rod being orientated perpendicular to said channel;

a lever assembly being pivotally attached to said pivot rod, said lever assembly being selectively rotated in a first direction forward of said bracket assembly or in a second direction rearward of said bracket assembly, said lever assembly including a foot portion having a top surface, a bottom surface, a rear surface and front surface, said front surface being arcuate from said top surface to said bottom surface and defining an arcuate edge defined by an arc having an axis aligned with said top surface, said pivot rod extending through and being pivotally coupled to said foot portion, said pivot rod being positioned generally between said axis and said bottom surface, said pivot rod being orientated parallel to said axis, wherein a juncture of said top surface and said front surface extends forward when said foot portion is rotated in said first direction;

a locking assembly being attached to said lever assembly and said bracket assembly for selectively preventing rotation of said lever assembly in said second direction; and wherein said lever assembly may be rotated in said first direction such that said lever assembly abuts the loose horizontal board and urges the loose horizontal board away from the bracket assembly.

* * * * *